US008713963B2

(12) United States Patent
Yanik

(10) Patent No.: US 8,713,963 B2
(45) Date of Patent: May 6, 2014

(54) ECONOMIZED VAPOR COMPRESSION CIRCUIT

(75) Inventor: Mustafa Kemal Yanik, York, PA (US)

(73) Assignee: Johnson Controls Technology Company, Holland, MI (US)

( * ) Notice: Subject to any disclaimer, the term of this patent is extended or adjusted under 35 U.S.C. 154(b) by 25 days.

(21) Appl. No.: 13/479,722

(22) Filed: May 24, 2012

(65) Prior Publication Data

US 2012/0234036 A1 Sep. 20, 2012

Related U.S. Application Data

(62) Division of application No. 12/041,978, filed on Mar. 4, 2008, now abandoned.

(60) Provisional application No. 60/952,280, filed on Jul. 27, 2007.

(51) Int. Cl.
*F25B 41/00* (2006.01)
*F25B 40/02* (2006.01)

(52) U.S. Cl.
CPC ..... *F25B 40/02* (2013.01)
USPC ..... 62/513

(58) Field of Classification Search
CPC ..... F25B 40/02; F25B 2400/13
USPC ..... 62/113, 175, 197, 510, 513, 434, 498
See application file for complete search history.

(56) References Cited

U.S. PATENT DOCUMENTS 4,370,868 A 2/1983 Kim
4,484,452 A 11/1984 Houser, Jr.
4,899,555 A * 2/1990 Shaw ..... 62/505
4,947,655 A 8/1990 Shaw
5,168,925 A 12/1992 Suzumura
5,174,123 A 12/1992 Erickson
5,327,959 A 7/1994 Saperstein
5,372,188 A 12/1994 Dudley
5,448,899 A 9/1995 Ohara
5,479,784 A 1/1996 Dobmeier
5,826,646 A 10/1998 Bae
5,836,382 A 11/1998 Dingle
5,901,782 A 5/1999 Voss
5,901,785 A 5/1999 Chiba
5,910,167 A 6/1999 Reinke
5,934,367 A 8/1999 Shimmura
5,967,228 A 10/1999 Bergman
6,148,635 A 11/2000 Beebe
6,155,075 A 12/2000 Hanson
6,199,401 B1 3/2001 Haussmann (Continued)

FOREIGN PATENT DOCUMENTS

EP 0219974 A2 4/1987
EP 0583851 A2 2/1994

(Continued)

*Primary Examiner* — Frantz Jules
*Assistant Examiner* — Emmanuel Duke
(74) *Attorney, Agent, or Firm* — McNees Wallace & Nurick LLC

(57) ABSTRACT

An economized vapor compression circuit is disclosed. An evaporator, compressor, condenser and economizer are fluidly connected by a refrigerant line containing refrigerant. A portion of the liquid refrigerant leaving the economizer is diverted away from the evaporator to sub-cool liquid refrigerant at a location between the condenser and the evaporator.

11 Claims, 3 Drawing Sheets

(56) References Cited

U.S. PATENT DOCUMENTS

| | | | | |
|---|---|---|---|---|
| 6,385,980 | B1 * | 5/2002 | Sienel | 62/174 |
| 6,428,284 | B1 | 8/2002 | Vaisman | |
| 6,449,979 | B1 | 9/2002 | Nagasawa | |
| 6,474,087 | B1 * | 11/2002 | Lifson | 62/199 |
| 6,502,413 | B2 | 1/2003 | Repice | |
| 6,688,137 | B1 | 2/2004 | Gupte | |
| 6,814,136 | B2 | 11/2004 | Yi | |
| 6,820,434 | B1 | 11/2004 | Gutheim et al. | |
| 6,827,128 | B2 | 12/2004 | Philpott | |
| 6,868,696 | B2 | 3/2005 | Ikuta | |
| 6,886,349 | B1 | 5/2005 | Curicuta | |
| 6,892,802 | B2 | 5/2005 | Kelly | |
| 6,904,966 | B2 | 6/2005 | Philpott | |
| 6,912,864 | B2 | 7/2005 | Roche | |
| 6,932,153 | B2 | 8/2005 | Ko | |
| 6,941,769 | B1 * | 9/2005 | Hill et al. | 62/512 |
| 6,964,296 | B2 | 11/2005 | Memory | |
| 6,988,538 | B2 | 1/2006 | Merkys | |
| 7,000,415 | B2 | 2/2006 | Daddis | |
| 7,003,971 | B2 | 2/2006 | Kester | |
| 7,021,370 | B2 | 4/2006 | Papapanu | |
| 7,028,483 | B2 | 4/2006 | Mansour | |
| 7,044,200 | B2 | 5/2006 | Gupte | |
| 7,059,151 | B2 * | 6/2006 | Taras et al. | 62/513 |
| 7,066,243 | B2 | 6/2006 | Horiuchi | |
| 7,080,526 | B2 | 7/2006 | Papapanu | |
| 7,107,787 | B2 | 9/2006 | Inaba | |
| 7,143,605 | B2 | 12/2006 | Rohrer | |
| 7,163,052 | B2 | 1/2007 | Taras | |
| 7,201,015 | B2 | 4/2007 | Feldman | |
| 7,219,511 | B2 | 5/2007 | Inaba | |
| 7,222,501 | B2 | 5/2007 | Cho | |
| 7,299,649 | B2 | 11/2007 | Healy | |
| 2002/0021972 | A1 * | 2/2002 | Vaisman | 417/310 |
| 2004/0035122 | A1 * | 2/2004 | Lifson et al. | 62/113 |
| 2004/0134226 | A1 | 7/2004 | Kraay | |
| 2004/0237549 | A1 | 12/2004 | Okawara et al. | |
| 2005/0183432 | A1 | 8/2005 | Cowans et al. | |
| 2006/0010893 | A1 | 1/2006 | Dominguez | |
| 2006/0053823 | A1 | 3/2006 | Taras et al. | |
| 2006/0090503 | A1 | 5/2006 | Lifson et al. | |
| 2006/0102332 | A1 | 5/2006 | Taras | |
| 2006/0130517 | A1 | 6/2006 | Merkys | |
| 2006/0245944 | A1 | 11/2006 | Leck et al. | |
| 2007/0017240 | A1 | 1/2007 | Shapiro | |
| 2007/0039724 | A1 | 2/2007 | Trumbower | |
| 2007/0101759 | A1 | 5/2007 | Matsuoka et al. | |
| 2007/0125121 | A1 | 6/2007 | Suzuki et al. | |

FOREIGN PATENT DOCUMENTS

| | | | | |
|---|---|---|---|---|
| EP | 1203916 | A1 | 5/2002 | |
| EP | 1795834 | A2 | 4/2006 | |
| JP | 04177069 | | 6/1992 | |
| JP | 20022156161 | | 5/2002 | |
| TW | I286877 | | 9/2007 | |
| WO | 02103270 | A1 | 12/2002 | |
| WO | WO 2005019737 | A2 * | 3/2005 | |
| WO | 2006015741 | A2 | 2/2006 | |
| WO | 2006083426 | A1 | 8/2006 | |
| WO | 2006083435 | A2 | 8/2006 | |
| WO | 2006083441 | A2 | 8/2006 | |
| WO | 2006083442 | A2 | 8/2006 | |
| WO | 2006083443 | A2 | 8/2006 | |
| WO | 2006083445 | A2 | 8/2006 | |
| WO | 2006083446 | A2 | 8/2006 | |
| WO | 2006083447 | A2 | 8/2006 | |
| WO | 2006083448 | A2 | 8/2006 | |
| WO | 2006083449 | A2 | 8/2006 | |
| WO | 2006083450 | A2 | 8/2006 | |
| WO | 2006083451 | A2 | 8/2006 | |
| WO | 2006083484 | A1 | 8/2006 | |
| WO | 2006135356 | A1 | 12/2006 | |
| WO | WO 2006135356 | A1 * | 12/2006 | C09K 5/04 |
| WO | 2007142619 | A2 | 12/2007 | |

* cited by examiner

ECONOMIZED VAPOR COMPRESSION CIRCUIT

CROSS-REFERENCE TO RELATED APPLICATIONS

This application is a divisional of U.S. application Ser. No. 12/041,978, filed Mar. 4, 2008, which claims the benefit of U.S. Provisional Application No. 60/952,280, filed Jul. 27, 2007, both of which are hereby incorporated by reference.

BACKGROUND

The application generally relates to heating, ventilation, air conditioning and refrigeration (HVAC&R) systems.

Vapor compression refrigeration cycles typically require sub-cooling (i.e. cooling the refrigerant to a temperature lower than the saturation temperature at the condenser pressure) at the condenser outlet for stable operation of metering devices, such as expansion valves; sub-cooling also increases the refrigeration effect of refrigerant in the evaporator. Due to a low heat transfer coefficient of liquid refrigerants and small temperature differences between the refrigerant and the cooling fluid, the surface area of the condenser to achieve the desired level of sub-cooling can become considerable and a significant portion of the condenser surface can be dedicated to sub-cooling the refrigerant. Thus, the efficiency of the condenser, and in turn the entire system, is restricted.

Using a significant portion of the condenser surface for sub-cooling can have a negative impact on system efficiency, as surface area of the condenser that could be used for condensation is instead used for sub-cooling, resulting in a higher compressor discharge pressure being required.

More recent condenser coil technologies, such as multi-channel heat exchangers, operate at a lower condensing temperature, which reduces the temperature difference between the liquid refrigerant and air. This, in turn, increases the importance of sub-cooling in systems using such heat exchangers.

In other cases, liquid refrigerant may need to be piped over relatively long distances. As a result of the pressure drop across such distances, phase changes can occur at undesired locations, which may be avoided by first adequately subcooling the refrigerant.

Intended advantages of exemplary embodiments satisfy one or more of these needs or provide other advantageous features. Other features and advantages will be made apparent from the present specification. The teachings disclosed extend to those embodiments that fall within the scope of the claims, regardless of whether they accomplish one or more of the aforementioned needs.

SUMMARY

One embodiment relates to an economized vapor compression circuit that includes an evaporator, a compressor, a condenser and an economizer. The evaporator, compressor, condenser and economizer are fluidly connected by a refrigerant line containing refrigerant, wherein liquid refrigerant leaving the economizer is split into a first stream and second stream. At a location intermediate the condenser and the evaporator, the first stream of refrigerant flows in a heat exchange relationship with refrigerant to be provided to the evaporator in which the first stream of liquid refrigerant expands and evaporates, subcooling refrigerant to be provided to the evaporator, the second stream of liquid refrigerant leaving the economizer flows to the evaporator.

In one exemplary embodiment, the economizer is a heat exchanger in which the sub-cooling also takes place. In another exemplary embodiment, the economizer is a flash tank and a separate sub-cooling heat exchanger is employed.

Another embodiment relates to a method for operating a vapor compression circuit that includes providing a refrigerant circuit having a condenser, an evaporator, an economizer, an expansion device, and a compressor fluidly connected by a refrigerant line containing refrigerant, directing substantially all refrigerant leaving the condenser to a first side of the economizer, diverting a minority portion of liquid refrigerant leaving the first side of the economizer to expand and enter a second side of the economizer to exchange heat with refrigerant in the first side of the economizer, and sub-cooling refrigerant in the first side of the economizer.

Still another embodiment relates to an economized vapor compression circuit that includes a compressor, a condenser, an economizer, an expansion device and an evaporator connected in a closed refrigeration loop. The economizer is configured to receive all refrigerant leaving the condenser and to provide sub-cooled liquid refrigerant to the evaporator. A portion of the liquid refrigerant leaving the economizer is diverted back to the economizer to exchange heat with the refrigerant entering the economizer from the condenser to sub-cool refrigerant being provided to the evaporator.

Certain advantages of some embodiments described herein include that by reducing or eliminating the need for sub-cooling at the condenser outlet permits the discharge pressure at the compressor to be lowered, resulting in better efficiency of the overall system. The size of the condenser surface may also be reduced so that the corresponding cost of the condenser is lowered.

In other embodiments, the sub-cooling may permit liquid refrigerant to be piped over longer distances.

Alternative exemplary embodiments relate to other features and combinations of features as may be generally recited in the claims.

DETAILED DESCRIPTION OF THE EXEMPLARY EMBODIMENTS

Figure 1:
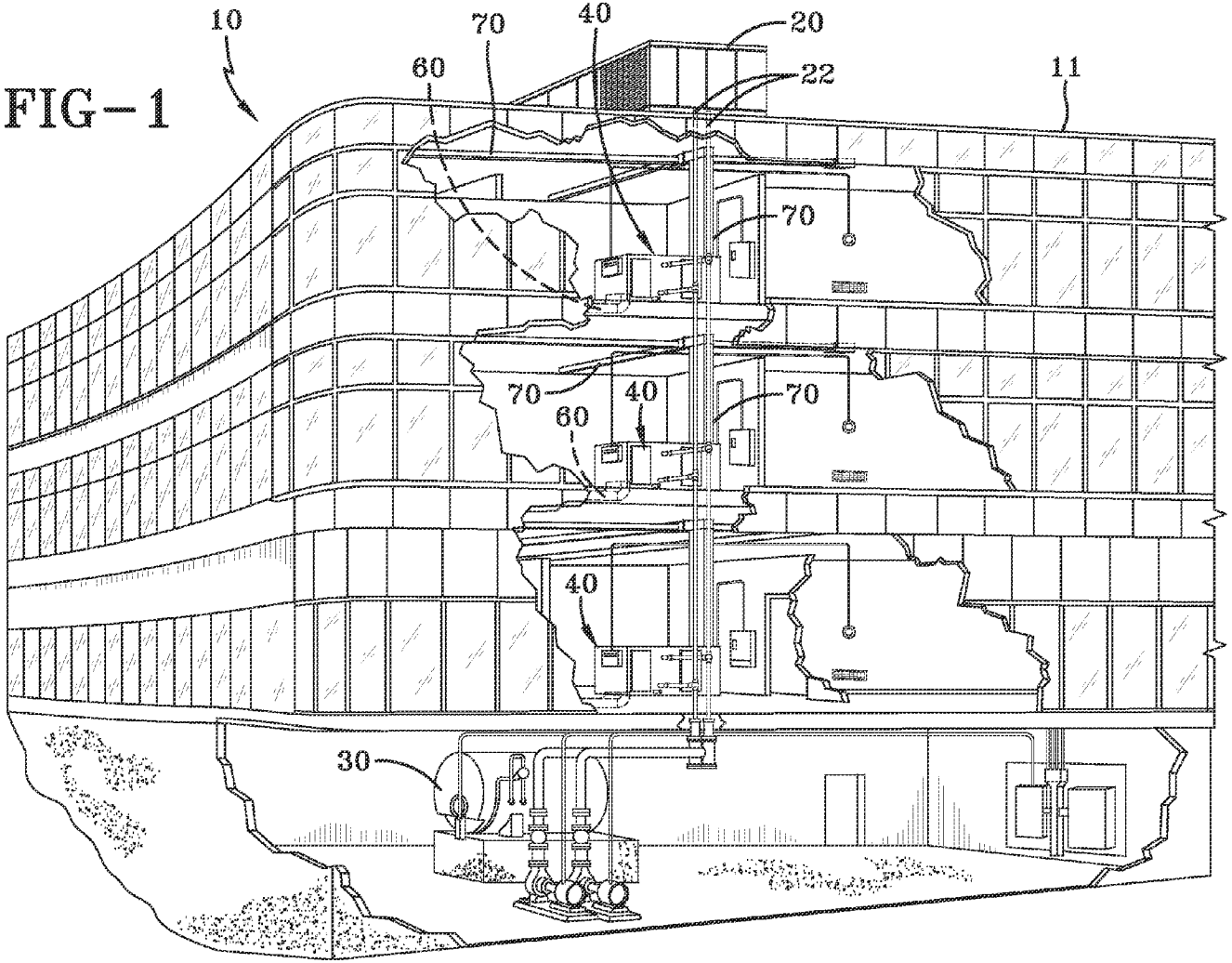
FIG. 1 depicts a cutaway view of a building that is equipped with an HVAC&R system.

FIG. 1 shows an exemplary HVAC&R system 10 for a building 11 in a typical commercial setting. A chiller 20 circulates a cooling fluid, such as water, to a heat exchanger contained in an air handler 40 in fluid communication with chiller 20 by conduits 22. HVAC&R system 10 is shown with a separate air handler 40 on each floor of building 11, but it will be appreciated that these components may be shared between or among floors.

Air handler 40 uses ducting 70 to draw outside air into HVAC&R system 10 that is mixed with air returned from within building 11 in air return duct 60. The cooling fluid absorbs heat from the mixture of outside air and returned air, cooling that mixture which is then provided throughout building 11; in turn, the warmed cooling fluid returns to chiller 20, where it is cooled again by a refrigerant. In a similar manner, a boiler 30 may be used to circulate a heated fluid for providing heating to the building 11.

As discussed, the warmed cooling fluid returning to chiller 20 is cooled by a refrigerant, which refrigerant is itself warmed and cooled in a closed loop within chiller 20. The refrigerant in the closed loop undergoes cyclic state changes within chiller 20 from vapor to liquid and then from liquid back to vapor depending on whether the refrigerant is absorbing or releasing energy as heat. This closed loop is known as a refrigerant cycle, and is sometimes more generically referred to as a vapor compression cycle.

Figure 2:
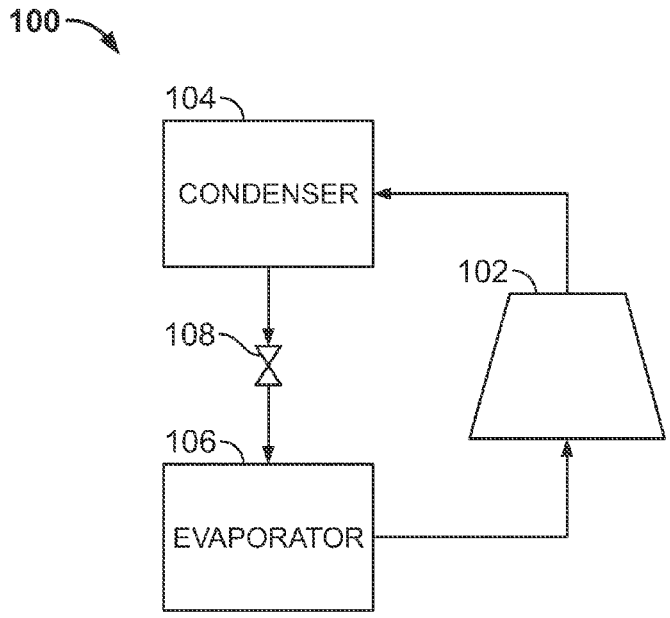
(Prior Art) FIG-2
FIG. 2 is a schematic illustration of a vapor compression circuit.

Referring to FIG. 2, a schematic vapor compression circuit 100 showing a basic vapor compression cycle is illustrated. The basic circuit 100 includes a compressor 102, a condenser 104, and an evaporator 106 which are fluidly connected to one another, typically by one or more lines of piping.

Compressor 102 compresses refrigerant in vapor form and delivers the vapor to condenser 104 through a discharge line. The refrigerant vapor is delivered by compressor 102 to condenser 104 where it enters into a heat exchange relationship with a fluid, such as the outside air surrounding building 11. The compressed vapor undergoes a phase change to a refrigerant liquid as a result of the heat exchange relationship with the fluid. The condensed liquid refrigerant from condenser 104 flows through an expansion device 108 to evaporator 106.

The condensed liquid refrigerant delivered to evaporator 106 enters into a heat exchange relationship with a second fluid. In the chiller example discussed above, the second fluid is the warmed water returning to chiller 20 from air handler(s) 40. In evaporator 106, the heat absorbed from the water causes the liquid refrigerant to undergo a phase change to a refrigerant vapor (and thereby cooling the water for distribution back to the air handler(s) 40 as discussed above). The vapor refrigerant exits evaporator 106 and returns to compressor 102 by a suction line to complete the cycle. Compressor 102 can be driven by a motor (not shown).

It will be appreciated that while the basic vapor compression circuit 100 and exemplary embodiments of the invention are primarily described herein with respect to HVAC&R system 10 having chiller 20 as illustrated in FIG. 1, exemplary embodiments of the invention are capable of being implemented in any situation in which a vapor compression cycle is used and that reference to the specific HVAC&R system 10 and the chiller 20 of FIG. 1 is for context only.

Figure 3:
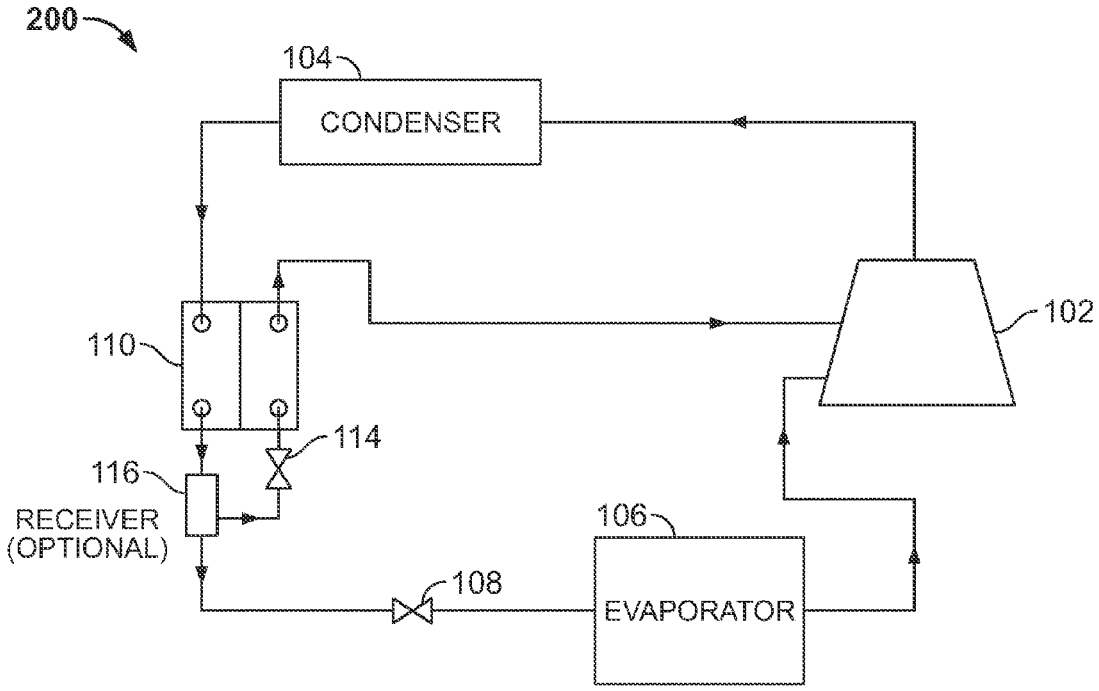
FIG. 3 is a schematic illustration of a vapor compression circuit according to an exemplary embodiment.
Figure 4:
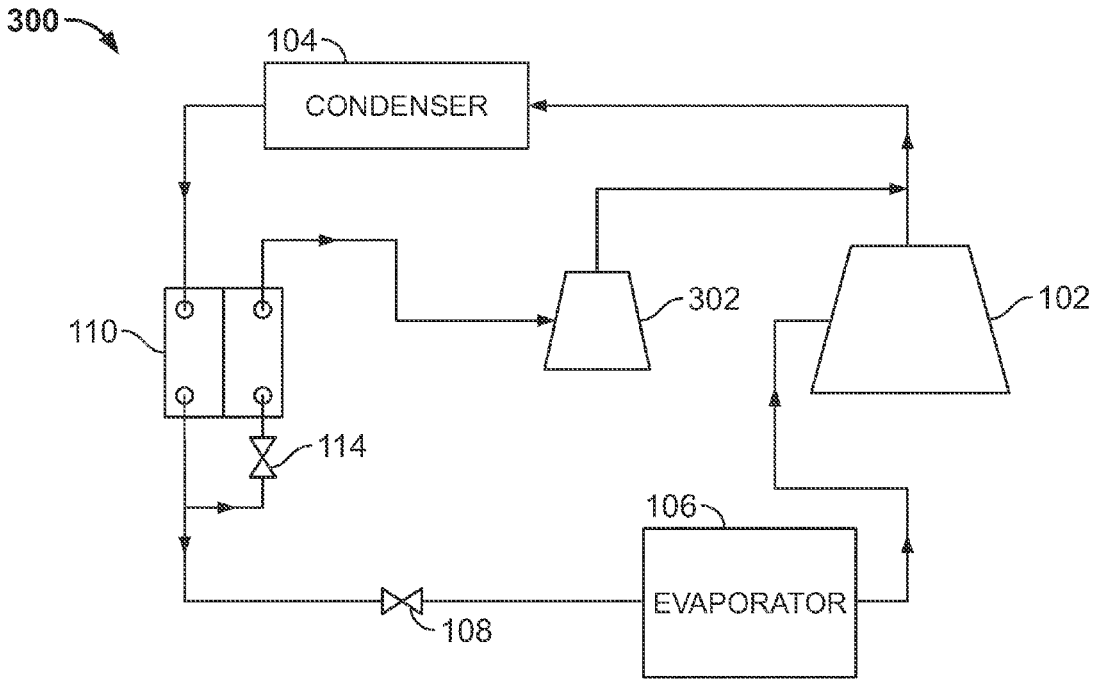
FIG. 4 is a schematic illustration of a vapor compression circuit according to another exemplary embodiment.

FIGS. 3 and 4 illustrate exemplary embodiments of circuits that modify the vapor compression cycle to accomplish sub-cooling of refrigerant other than at the outlet of condenser 104. By sub-cooling elsewhere in the circuit, greater system efficiency and a greater realization of the advantages provided by sub-cooling can be achieved.

In vapor compression circuits 200, 300 (FIGS. 3 and 4, respectively), refrigerant leaving condenser 104 may be a saturated liquid or may be a two-phase mixture with low vapor quality. In either case, substantially the entire flow of refrigerant leaving condenser 104 is directed to a "warm" side 110*a* of an economizer/sub-cooler heat exchanger 110 and the refrigerant is generally not appreciably sub-cooled when it leaves the outlet of condenser 104. That is, while some sub-cooling at the condenser 104 may occur, there is generally less than about 5° F. sub-cooling.

The use of economizer/sub-cooler heat exchanger 110 enables refrigerant from condenser 104 to be sub-cooled in economizer/sub-cooler 110, not in condenser 104. Upon exiting economizer/sub-cooler 110, the sub-cooled liquid refrigerant flow is divided into two streams. A minor portion forms a first stream that goes to an expansion valve 114 that supplies the "cool" side 110*b* of the economizer/sub-cooler 110, while the majority of the flow forms a second stream that passes to the evaporator, usually via the expansion valve 108. The "warm side" and "cool side" of a heat exchanger refer to the manner in which two streams of fluid flow through the heat exchanger without being in physical contact with one another, but are in thermal contact to exchange heat. Thus, by "warm" side is meant that the refrigerant enters one end of a heat exchanger warmer than it will leave the other end of the heat exchanger and is separated from the "cool" side, which refers to the separate flow path of a fluid that enters the heat exchanger that will be warmed during its residence time within the heat exchanger.

The refrigerant flowing through the cool side 110*b* of economizer/sub-cooler 110 is in a heat exchange relationship with refrigerant entering the warm side of economizer/sub-cooler 110 and thus absorbs heat from the refrigerant entering economizer/sub-cooler 110 from condenser 104. The refrigerant entering the cool side 110*b* of economizer/sub-cooler 110 is evaporated by the heat absorbed from the refrigerant flowing through the warm side 110*a*.

The amount of refrigerant diverted back to the cool side 110*b* of economizer/sub-cooler 110 may vary depending on the conditions and capacity of the particular HVAC&R system 10 in which the vapor compression cycle will be employed. In some embodiments, the amount diverted is about 10% to about 20% (by mass) of the liquid refrigerant stream leaving economizer/sub-cooler 110.

In one embodiment (FIG. 3), the stream of evaporated refrigerant leaving the cool side 110*b* of economizer/sub-cooler 110 is pulled to compressor 102. The evaporated refrigerant may be supplied to compressor 102 at the same or a different point, or intermediate pressure, than suction line refrigerant entering compressor 102 from evaporator 106. In another embodiment (FIG. 4), the evaporated stream of refrigerant leaving economizer/sub-cooler 110 is pulled to a secondary or auxiliary compressor 302 that discharges compressed refrigerant back into the discharge line leaving compressor 102.

A receiver 116 is optionally positioned between economizer/sub-cooler 110 and the expansion and return valves 108, 114, as shown in FIG. 3. If used, the receiver 116 serves as a collection/temporary holding tank for liquid refrigerant prior to delivery to evaporator 106 or to the cool side 110*b* of economizer/sub-cooler 110.

The exemplary vapor compression cycles illustrated in the circuits of FIGS. 3 and 4 differ from a traditional economizer cycle in that in a traditional economizer cycle, the refrigerant flow is split into two streams before entering an economizer, requiring the refrigerant to be sub-cooled prior to the economizer, i.e. in the condenser. That is, in the illustrated exemplary embodiments, the refrigerant flow is split after flowing through the warm side 110*a* of economizer/sub-cooler 110, which permits the refrigerant at the condenser outlet to have little to no sub-cooling.

By reducing or eliminating sub-cooling at condenser 104, the saturated condensing temperature will be comparatively less, as will the discharge pressure from compressor(s) 102, 302, resulting in an increase in the coefficient of performance for the circuit. Alternatively, the coefficient of performance could be maintained, but a smaller condenser could be used. Or, some combination of increased performance and smaller condenser size could be achieved.

Figure 5:
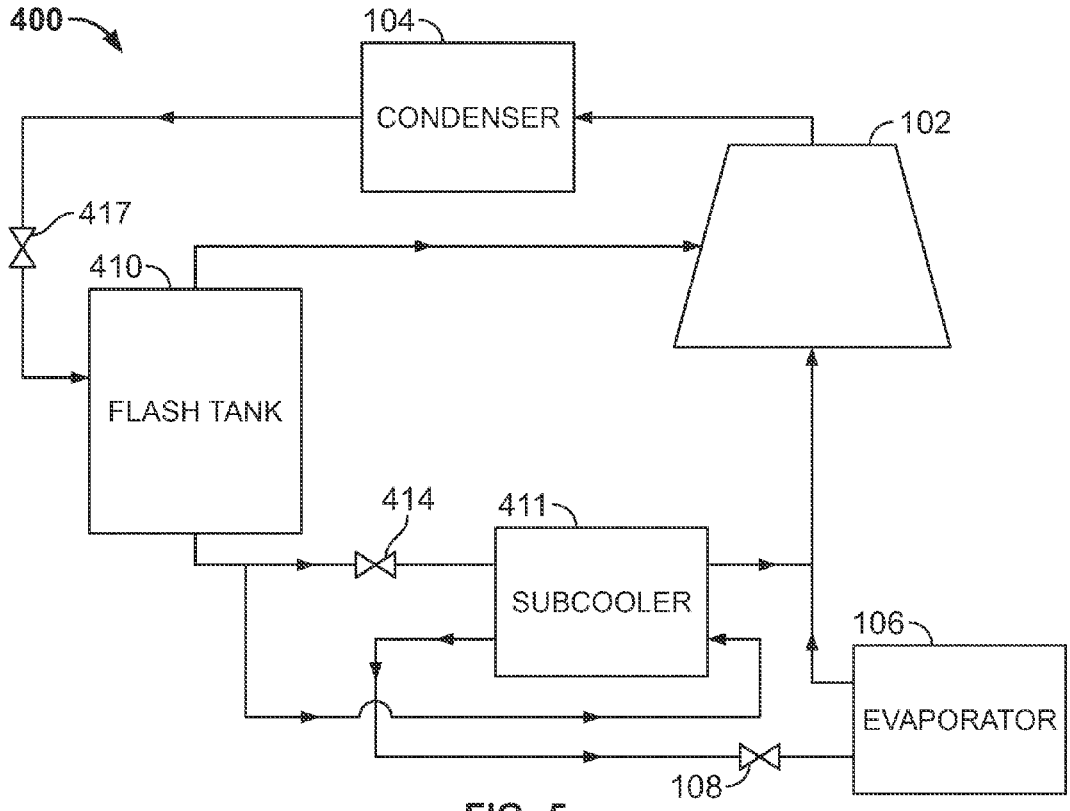
FIG. 5 is a schematic illustration of a vapor compression circuit according to yet another exemplary embodiment.

FIG. 5 illustrates yet another exemplary embodiment of a vapor compression circuit 400 having an economizer that is a flash tank 410 instead of a heat exchanger. This embodiment may be advantageous for use in a vapor compression cycle that employs evaporator 106 located at an extended distance away from flash tank 410. In such cases, the pressure drop caused by liquid refrigerant flowing to evaporator 106 at a remote location may result in a phase change from liquid to vapor occurring within the piping prior to reaching evaporator 106, resulting in improper system operation.

In vapor compression circuit 400, the refrigerant leaves condenser 104 and is sent to flash tank 410. Although not required, in this embodiment it may be desirable to sub-cool the refrigerant at the condenser outlet 104 in the conventional manner. In flash tank 410, a portion of the refrigerant is vaporized and returned to compressor 102, while the remaining liquid refrigerant leaves flash tank 410 as a saturated liquid. The liquid refrigerant from flash tank 410 is split into two streams.

A first stream is formed in which a small amount of the liquid refrigerant leaving a liquid outlet of flash tank 410 is diverted, then expanded through an expansion valve 414. This diverted refrigerant flows through the cool side 411*b* of a sub-cooler heat exchanger 411. The majority of the liquid refrigerant from flash tank 410 is undiverted, forming a second stream to be provided to evaporator 106 but which is first supplied to the warm side 411*a* of sub-cooler 411. Thus, in this embodiment, a separate, dedicated sub-cooling heat exchanger is employed after the refrigerant is first economized in the flash tank 410. The diverted liquid refrigerant of the first stream enters the cool side 411*b* of sub-cooler 411 and absorbs heat from the liquid refrigerant flowing through the warm side 411*a* of sub-cooler 411. The absorbed heat causes the cool side refrigerant to expand and evaporate, and in turn causes the warm side refrigerant to be sub-cooled.

The refrigerant leaving sub-cooler 411 is sufficiently sub-cooled to have enough pressure available to travel through piping that connects sub-cooler 411 to remote evaporator 106. The refrigerant evaporated in the cool side 411*b* of sub-cooler 411 may be connected to the compressor suction line to mix with the rest of the refrigerant coming from evaporator 106 as shown in FIG. 5, or may be supplied at an intermediate point in compressor 102, such as shown in FIG. 3.

It will be appreciated that it is the arrangement of the above-identified components of the vapor compression circuit to which exemplary embodiments of the invention are primarily directed. Thus, the specific types and/or styles of heat exchangers and other devices selected for the various components can be adjusted depending on the particular HVAC&R system with which exemplary embodiments of the invention are employed.

Thus, for example, condenser 104 can be any style of heat exchanger that condenses the refrigerant. In one embodiment, condenser 104 comprises one or more multi-channel heat exchangers, such as a mini-channel heat exchanger. However, condenser 104 could also be a fin and tube heat exchanger, a water cooled heat exchanger, or any other suitable heat exchanger. Similarly, evaporator 106 can also be a heat exchanger of any suitable configuration, e.g., multi-channel heat exchanger, fin and tube heat exchanger, water cooled heat exchanger, etc.

The term "multichannel heat exchanger" refers to arrangements in which heat transfer tubes include a plurality of flow paths between manifolds that distribute flow to and collect flow from the tubes. A number of other terms may be used in the art for similar arrangements. Such alternative terms might include "microchannel" (sometimes intended to imply having fluid passages on the order of a micrometer and less), and "microport". Other terms sometimes used in the art include "parallel flow" and "brazed aluminum." However, all such arrangements and structures are intended to be included within the scope of the term "multichannel." In general, such "multichannel" tubes will include flow paths disposed along the width or in a plane of a generally flat, planar tube, although, again, the invention is not intended to be limited to any particular geometry unless otherwise specified in the appended claims.

Compressor 102 can be any suitable type of compressor, e.g., rotary compressor, screw compressor, reciprocating compressor, centrifugal compressor, swing link compressor, scroll compressor, turbine compressor, or any other suitable compressor. The refrigerant may be any suitable refrigerant, including R134a or R410A by way of example only.

Regardless of whether the subcooling heat exchanger is also the economizer (e.g., FIGS. 3 and 4) or a dedicated unit (e.g. FIG. 5), any suitable heat exchanger such as a shell and tube heat exchanger, tube and tube heat exchanger or plate heat exchanger may be used.

It should be understood that the application is not limited to the details or methodology set forth in the following description or illustrated in the figures. It should also be understood that the phraseology and terminology employed herein is for the purpose of description only and should not be regarded as limiting.

While the exemplary embodiments illustrated in the figures and described herein are presently preferred, it should be understood that these embodiments are offered by way of example only. Accordingly, the present application is not limited to a particular embodiment, but extends to various modifications that nevertheless fall within the scope of the appended claims. The order or sequence of any processes or method steps may be varied or re-sequenced according to alternative embodiments.

It is important to note that the construction and arrangements shown in the various exemplary embodiments are illustrative only. Although only a few embodiments have been described in detail in this disclosure, those who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited in the claims. For example, elements shown as integrally formed may be constructed of multiple parts or elements, the position of elements may be reversed or otherwise varied, and the nature or number of discrete elements or positions may be altered or varied. Accordingly, all such modifications are intended to be included within the scope of the present application. Other substitutions, modifications, changes and omissions may be made in the design, operating conditions and arrangement of the exemplary embodiments without departing from the scope of the present application.

What is claimed is:

1. A vapor compression circuit comprising:

a compressor, a condenser, a flash tank economizer, an expansion device and an evaporator connected in a closed refrigeration loop;

the flash tank economizer being configured to receive refrigerant from the condenser, the flash tank economizer being operable to vaporize a portion of the refrigerant from the condenser and provide the vaporized refrigerant to the compressor; and a heat exchanger intermediate the flash tank economizer and the evaporator, liquid refrigerant leaving the flash tank economizer is split into a first stream and a second stream, the first stream and the second stream are directed to different sides of the heat exchanger such that the first stream enters into a heat exchange relationship with the second stream to subcool the second stream prior to the second stream being provided to the evaporator and prior to the first stream being provided to the compressor.

2. A vapor compression circuit comprising:

an evaporator;

a compressor;

a condenser;

a flash tank economizer;

the evaporator, compressor, condenser and flash tank economizer are fluidly connected by a refrigerant line containing refrigerant, wherein liquid refrigerant leaving the flash tank economizer is split into a first stream and second stream and vapor refrigerant leaving the flash tank economizer is provided to an intermediate pressure location of the compressor;

a sub-cooler positioned intermediate the flash tank economizer and the evaporator, the first stream of refrigerant flows through a first expansion device into the sub-cooler, the second stream of refrigerant flows into an opposite end of the sub-cooler from the first stream of refrigerant and enters into a heat exchange relationship with the first stream of refrigerant in which the first stream of refrigerant expands and evaporates, sub-cooling the second stream of refrigerant; and wherein the second stream of refrigerant from the heat exchanger flows through a second expansion device before entering the evaporator.

3. The vapor compression circuit of claim 2, wherein the flash tank economizer comprises a flash tank having a liquid refrigerant outlet and a gaseous refrigerant outlet and the sub-cooler comprises a heat exchanger.

4. The vapor compression circuit of claim 2, wherein the evaporated first stream of refrigerant from the heat exchanger is fluidly connected to a suction inlet of the compressor.

5. The vapor compression circuit of claim 2, wherein the evaporated first stream of refrigerant from the heat exchanger is fluidly connected to an intermediate pressure location of the compressor.

6. The vapor compression circuit of claim 2, wherein the condenser is a heat exchanger selected from the group consisting of a multi-channel heat exchanger, fin and tube heat exchanger, and water cooled heat exchanger.

7. The vapor compression circuit of claim 2, wherein the evaporator is a heat exchanger selected from the group consisting of a multi-channel heat exchanger, fin and tube heat exchanger, and water cooled heat exchanger.

8. The vapor compression circuit of claim 2, wherein the compressor is selected from the group consisting of rotary compressors, screw compressors, reciprocating compressors, centrifugal compressors, swing link compressors, scroll compressors, and turbine compressors.

9. The vapor compression circuit of claim 2 further comprising an expansion device fluidly connected between the condenser and the flash tank economizer.

10. The vapor compression circuit of claim 2 wherein the first stream is a minority portion of the liquid refrigerant leaving the flash tank economizer.

11. The vapor compression circuit of claim 2 wherein the evaporator is located an extended distance from the flash tank economizer.

* * * * *